US005496043A

United States Patent [19]

Ester

[11] Patent Number: 5,496,043

[45] Date of Patent: Mar. 5, 1996

[54] OVER THE ARROW SHAFT BROAD HEAD

[76] Inventor: Lee Ester, 4627 W. Elgin St., Chandler, Ariz. 85226

[21] Appl. No.: 926,502

[22] Filed: Aug. 7, 1992

[51] Int. Cl.[6] ..... F42B 6/08

[52] U.S. Cl. ..... 273/422

[58] Field of Search ..... 273/416, 419–422

[56] References Cited

U.S. PATENT DOCUMENTS

| | | | |
|---|---|---|---|
| 3,910,579 | 10/1975 | Sprandel | 273/422 |
| 4,254,958 | 3/1981 | Bateman, III | 273/421 |
| 4,268,038 | 5/1981 | Wierenga | 273/416 |
| 4,380,340 | 4/1983 | Simo | 273/416 |
| 4,643,435 | 2/1987 | Mosacchia | 273/422 |
| 4,986,550 | 1/1991 | Segovia | 273/422 |
| 5,066,021 | 11/1991 | De Lucia | 273/421 |

OTHER PUBLICATIONS

Archery, Apr. 1978, p. 14, Snuggers.

*Primary Examiner*—Paul E. Shapiro
*Attorney, Agent, or Firm*—Martin L. Stoneman

[57] ABSTRACT

An overshaft hunting broadhead is used to duplicate practice arrow balance point and flight characteristics. Assuming the optimal balance point of the practice arrow is in accord with manufacturer's recommendations, removal of the practice arrow point and converting to an overshaft hunting broadhead will duplicate the balance point, weight and flight characteristics of the arrow the archer has become accustomed to while practicing. The arrow shaft enters the ferrule of the overshaft hunting broadhead. The ferrule is free to rotate about the axis of the arrow's shaft to be properly positioned, then securely tightened by rotating the arrow tip. The ferrule is equipped to hold cutting edges (razors). The ferrule is coupled securely to the end of the arrow shaft by a hunting point tip that couples into a standard threaded insert in the arrow shaft. The broad head ferrule will not experience the load at impact that is typical to existing broad head styles due to the reinforcement of the arrow shaft by an arrow shaft insert located concentrically and internally beneath the overshaft broadhead ferrule.

4 Claims, 3 Drawing Sheets

OVER THE ARROW SHAFT BROAD HEAD

TECHNICAL FIELD OF THE INVENTION

The invention relates to the field of archery. In particular, the invention relates to the means and particular method of attaching a hunting broad head to an arrow shaft for improved performance in arrow flight characteristics.

PRIOR BACKGROUND ART

Arrow shafts, in general, are equipped with replaceable arrowheads. There are many reasons for this, not the least of which is to permit the ready replacement of a damaged arrowhead while an archer is in the field. More frequently, an archer is prompted to change arrowheads when he changes the type of shooting with which he is involved. Thus, the archer may have been shooting at straw targets or the like, using standard arrow points, and decide to mount hunting heads on each of his arrow shafts so that he might partake of the hunt.

Assuming that the archer has been having success using an arrow point of a given weight, he will, in all likelihood, install a hunting head of the same weight. Having done so, it may come as a surprise to the archer to find that the flight of the arrow is erratic; and, the accuracy he has gained in practice with the arrow point on his shaft is no longer in evidence when shooting with a hunting head.

Hunting heads (broadheads) are designed to cut, producing hemorrhaging in body. Hunting heads typically carry many different styles of cutting edges (razors), some fixed, some folding out of the hunting head ferrule body at impact. Although the heads differ in cutting configuration and design, they each have a means for coupling to the end of an arrow shaft. Typically, an existing hunting head has a threaded shaft protruding rearward from its end. The arrow has an internally threaded insert at it's forward end for receiving this threaded shaft. The threaded insert is commonly glued into the arrow shaft's leading end.

Typical arrow shafts are hollow in design. However, there are arrows used having shafts that are of solid construction, usually wood. Typical fittings are readily available to convert this type of arrow shaft to allow for threaded arrow points.

When inserted and rotated securely into the arrow insert, current hunting broad heads will terminate rotation at random radial positions; and, because of their length they increase the arrow's overall assembled length. The uncontrolled radial positioning of the broad head and the increased assembled length is undesirable.

In current, common practice, the archer wants to assemble his broadheaded arrow in a manner that maximizes cutting blade clearance on the bow and allow blade alignment with the flights on the arrow. In the prior art, this could only be achieved by successively installing many different hunting heads to a single arrow shaft hoping that one would couple at the correct radial position. Most commonly however, an archer, in frustration, will remove the arrow head and insert from the shaft and glue the assembly to the shaft in proper orientation. This marriage of the glued assembly to the arrow shaft to achieve correct radial alignment makes the arrow, insert and hunting head inseparable and dangerous to transport to the hunt location.

Although the overall weight of the arrow may not be changed by changing from arrow point to broadhead hunting point, the archer may not realize that the overall geometry of the arrow has been sufficiently changed to move the balance point and inpair the flight characteristics of the arrow to which he had become accustomed.

The balance point of the arrow is of critical importance. In tests of the accuracy of arrows, both actual and computer simulated testing, it has been shown that arrows are most accurate when they are seven to ten per cent (front of center) nose heavy. While many archers are familiar with this rule, they are limited as to where the balance point of their arrow will fall based on their selection of a particular broadhead hunting point. As is many times the case, the arrow's balance point will not be the same as when a practice arrow point was attached.

It is the objective of the present invention to enable an archer to exactly duplicate his arrow's finished length, weight, balance point and flight characteristics when changing from practice arrow points to broadhead hunting points, within the established standards set by the manufacturers of the various arrow shafts and devices. This will be accomplished by utilizing a broadhead hunting point that weighs the same (or approximately the same) as the practice arrow point, and, will duplicate the overall assembled length of the practice arrow when the invention disclosed herein is utilized. Another objective of the invention will allow the ready alignment of the arrow flights to the broadhead razors.

SUMMARY DESCRIPTION OF THE INVENTION

The invention represents an improvement in ar arrow which has an arrow shaft with a threaded insert at a first end thereof. The insert is internal to and concentric with the shaft. There is an arrow tip, having a threaded extension, thread coupled to the insert. The improvement includes a broad head cutting blade. Means are coupled to the shaft for coupling the broad head cutting blade to the arrow shaft at first end of the shaft and above the outer surface of the shaft.

The means for coupling the broad head cutting blade to the arrow shaft further comprises means coupled to the shaft for lockingly, removably coupling the broad head cutting blade to the shaft. This, in turn is made up of locking means coupled to the shaft in cooperation with the arrow tip whereby the threaded rotation of the tip functions to lock and release the broad head cutting blade from its coupling with the shaft.

The locking means itself comprises means coupling the arrow tip, the shaft, and the cutting blade for drawing the cutting blade into locked, intimate contact with the outer surface of the shaft as the tip threadedly rotated into the threaded insert. The locking means also releases the locked, intimate contact as the tip is threadedly rotated out of the threaded insert.

The means for drawing the cutting blade into locked intimate contact with the shaft further comprises means for lockingly positioning the cutting blade at selected radial angles with respect to the shaft.

In a presently preferred embodiment, the means for lockingly, removable coupling the broad head cutting blade to the shaft comprises a ferrule rotatingly encompassing the first end of the arrow shaft and extending a selected length away from the first end along the arrow shaft to the broad head cutting blade is removably coupled to the ferrule and it extends along the ferrule away from the first end of the arrow shaft. Included are means for lockingly coupling the blade and the ferrule to the shaft at a selected radial angle to the shaft.

The means for lockingly coupling the blade and the ferrule to the shaft at a selected radial angle comprises compression means coupled to the arrow tip to exert a compressive force on the broad head cutting blade to lockingly position the ferrule and the cutting blade on the arrow shaft as the arrow tip is threadedly rotated into the insert. The ferrule has an outer wall with a longitudinal slot therethrough. The broad head cutting blade is coupled within the slot and thereby comes into contact with the surface of the arrow shaft.

BRIEF DESCRIPTION OF THE DRAWINGS

FIG. 4A illustrates the overshaft broadhead invention and arrow assembly. FIG. 4B illustrates a typical prior art broadhead and arrow assembly. FIG. 4C illustrates a typical prior art target point and arrow assembly.

DETAILS OF BEST MODE FOR CARRYING OUT THE INVENTION

Figure 1:
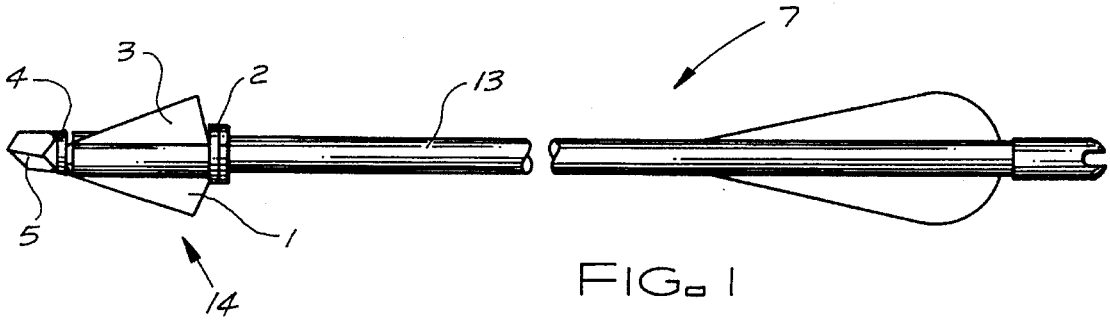
FIG. 1 illustrates the evershaft broadhead invention installed on an arrow shaft.

For purposes of promoting an understanding of the principles of the invention, reference will now be made to the embodiments illustrated in the drawings and specific language will be used to describe same. It will never the less be understood that no limitation of the scope of the invention is thereby intended. Alterations and modifications of the illustrated device are contemplated, as are such further applications of the principles of the invention as would normally occur to one skilled in the art to which the invention pertains.

FIG. 1 illustrates arrow assembly 7 with the invention, broadhead 7, made up of components: ferrule 1, razor ring 2, razor(s) 3, razor retaining washer 4 and hunting point tip 5 installed on typical arrow shaft 13.

Figure 2:
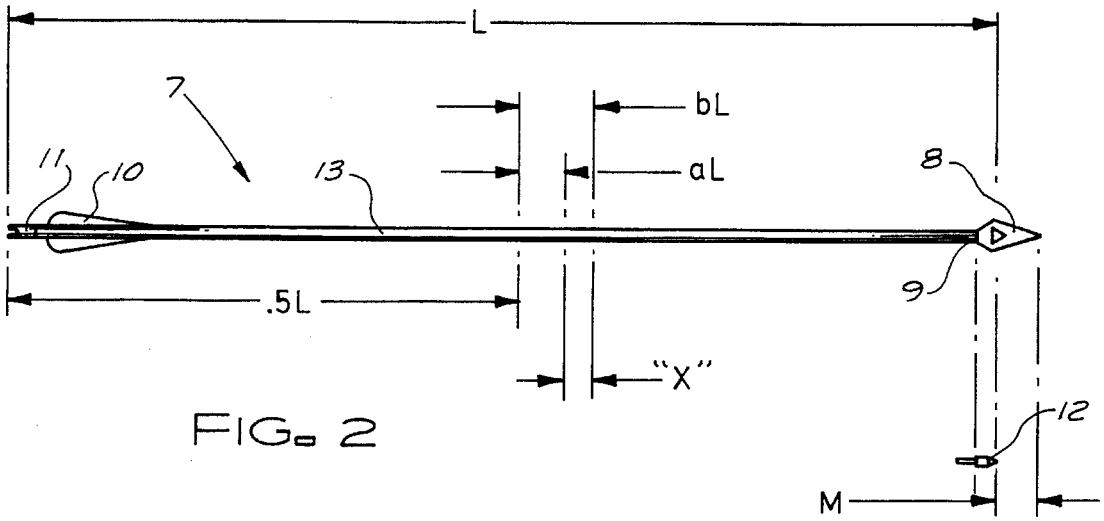
FIG. 2 establishes arrow balance point and calculation considerations defining the optimum balance region.

FIG. 2 illustrates the suggested actual values for establishing balance point on an arrow of length L. Arrow and equipment manufacturer's are presently suggesting that, in order for the flight of an arrow to be accurate, the arrow should be between (aL) and (bL) (region between designated "X") front heavy calculated from the overall length L of arrow 7. Arrow 7, being assembled with typical prior art target point 12, threaded arrow insert 9, flights 10, hock 11 and arrow shaft 13 has a given balance point and mass weight due to it's geometry of the assembled components. Assuming that assembled arrow 7 balances in the optimum region "X", any changes to nock 11, flights 10 and/or a particular prior art broadhead 8 or prior art arrow point 12, the overall length L of the arrow may possibly remain the same, however, in all likelihood the previous length L will change by some length and balance point will change at well. When length L of the assembled arrow 7 channels so will the region in which the balance point had been established. This change in the previous balance point, will cause assembled arrow 7 (with broadhead 8 installed) to act differently in flight when compared to assembled arrow 7 with arrow point 12 installed, even though broadhead 8 and arrow point 12 may weigh the same. This change in balance region resulting from an overall change in assembled arrow length (L±M) brings on different bending characteristics in assembled arrow 7 when shot from bow 6.

Figure 3A:
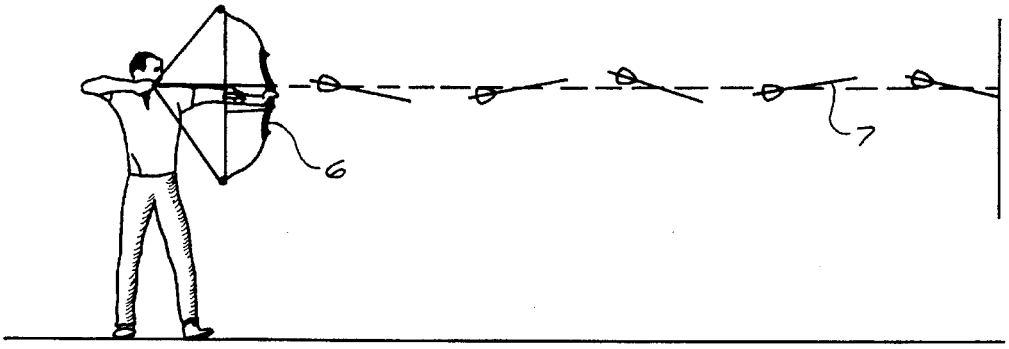
FIGS. 3A and 3B show the bending and wobbling phenomena typical to arrow flight.
Figure 3B:
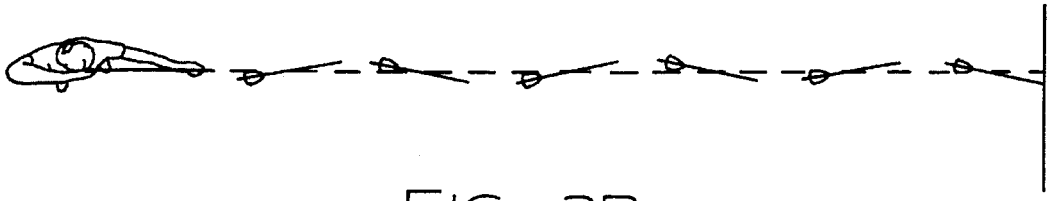

FIGS. 3A and 3B display the bending and wobbling phenomena typical of arrow 7's flight. Bending, wobbling and porpoising (a result of column buckling, due to the extreme acceleration arrow 7 experiences when shot from bow 6), must be consistent from arrow to arrow within an archer's usage. Changing from one point style to a different point style may negatively affect repeatable accuracy for which the archer has become accustomed. (Example, FIG. 2, broadhead 8 removed and arrow point 12 installed.)

Figure 4A:
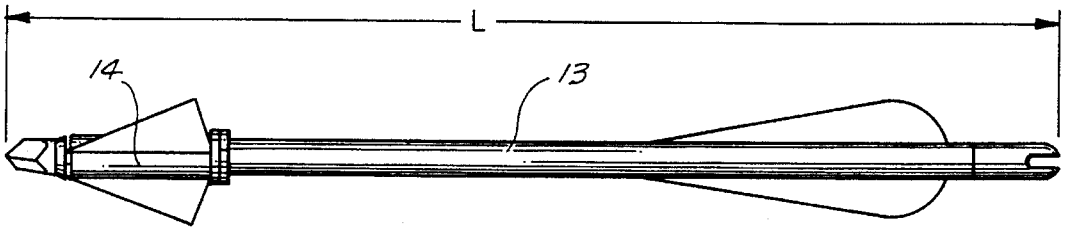
FIGS. 4A, 4B and 4C illustrate the assembled lengths gained with a typical arrow shaft equipped with various arrow tips.
Figure 4B:
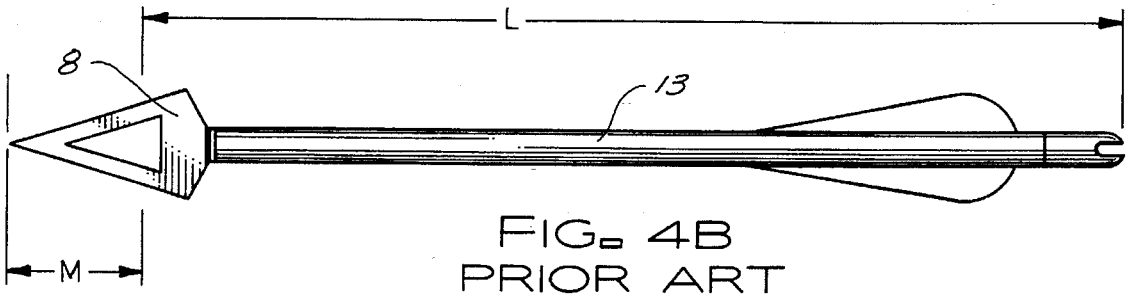
FIG. 4B PRIOR ART
Figure 4C:
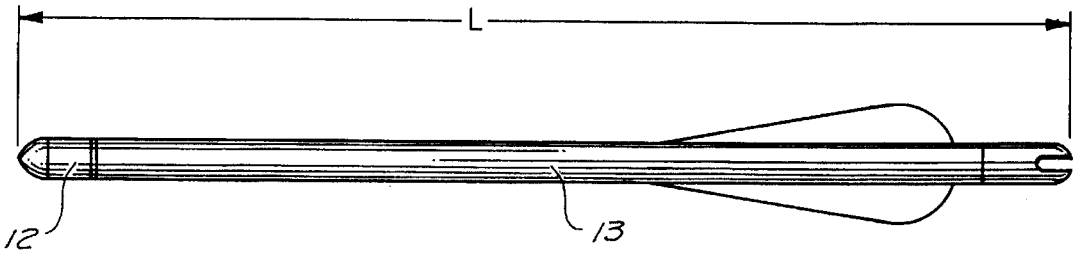
FIG. 4C PRIOR ART

In FIG. 4A, the invention, overshaft broadhead 14, is installed on raw arrow shaft 13 resulting in arrow length L. This length L, critical to repeatable balance point and down range accuracy, is duplicated in FIG. 4C with prior art arrow point 12 installed on the same raw arrow shaft 13. In FIG. 4B, prior art broadhead 8, when installed on raw arrow shaft 13, increases the overall length of the assembled arrow to a length L+M and typifies the current state of the art in broadhead designs as they relate to arrow assembly lengths.

Figure 5:
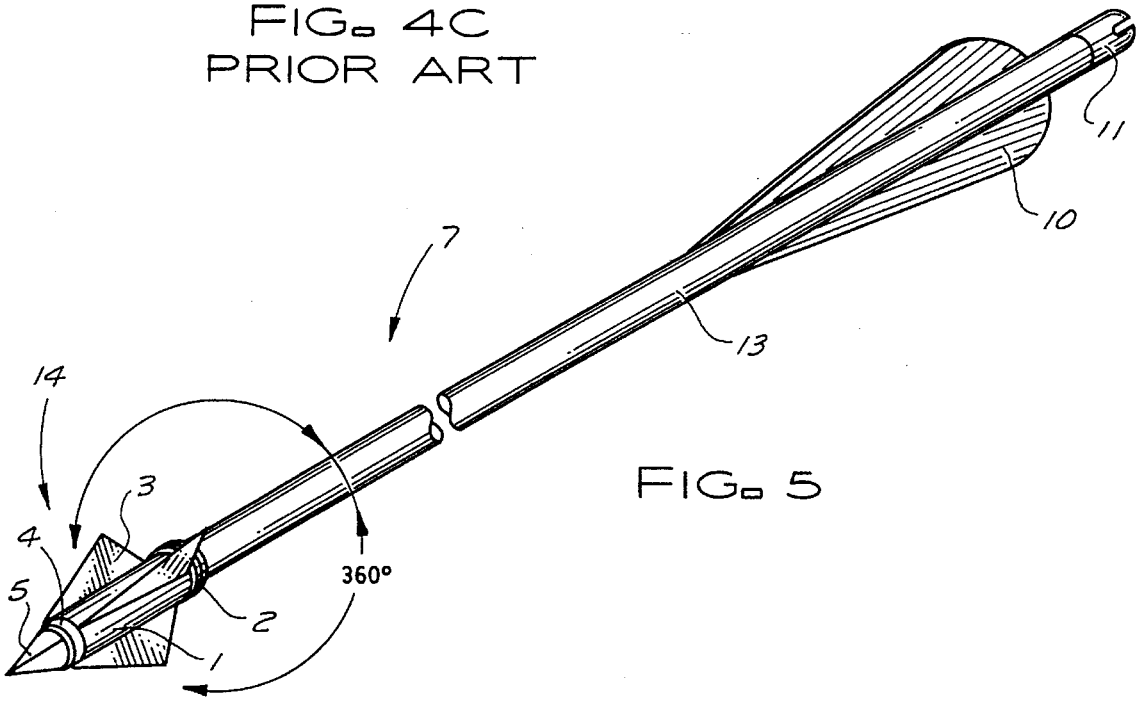
FIG. 5 displays the radial adjustment capabilities of the overshaft broadhead when installed on an arrow shaft.

In FIG. 5, the invention, overshaft broadhead 14, includes a threaded hunting point tip 5 used to secure the over shaft broadhead 14 assembly to arrow shaft 13. Since the broadhead ferrule 1 is independent of threaded hunting point tip 5, overshaft broadhead ferrule assembly can be rotated three hundred sixty degrees about the axis of arrow shaft 13 and be exactly located prior to locking it into position. This allows the overshaft broadhead 14 to be radially adjusted to whatever location razors 3 may need to be so as to maximize clearances of razors 3 when arrow 7 is shot from bow 6 (see FIG. 3), or, as is many times the case, lined up with razors 3 aligned with arrow flights 10. Threaded hunting point tip 5 passes through the razor retaining washer 4, through overshaft broadhead ferrule 1 and into arrow insert 9, (see FIG. 6) and, when rotated to tighten, draws itself (5) into the arrow shaft's threaded insert 9, to securely couple overshaft roadhead ferrule 1, razors 3 and the hunting point tip 5 securely in position.

Figure 6:
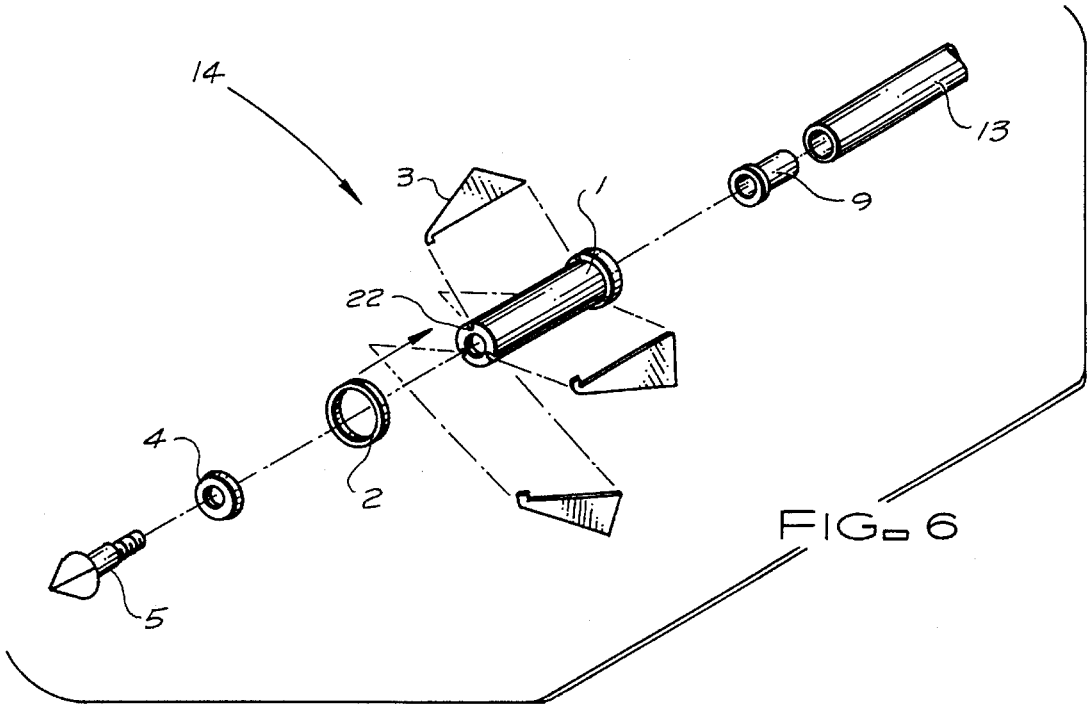
FIG. 6 is an exploded view of the overshaft broadhead and partial view of the arrow shaft and threaded insert.
Figure 7:
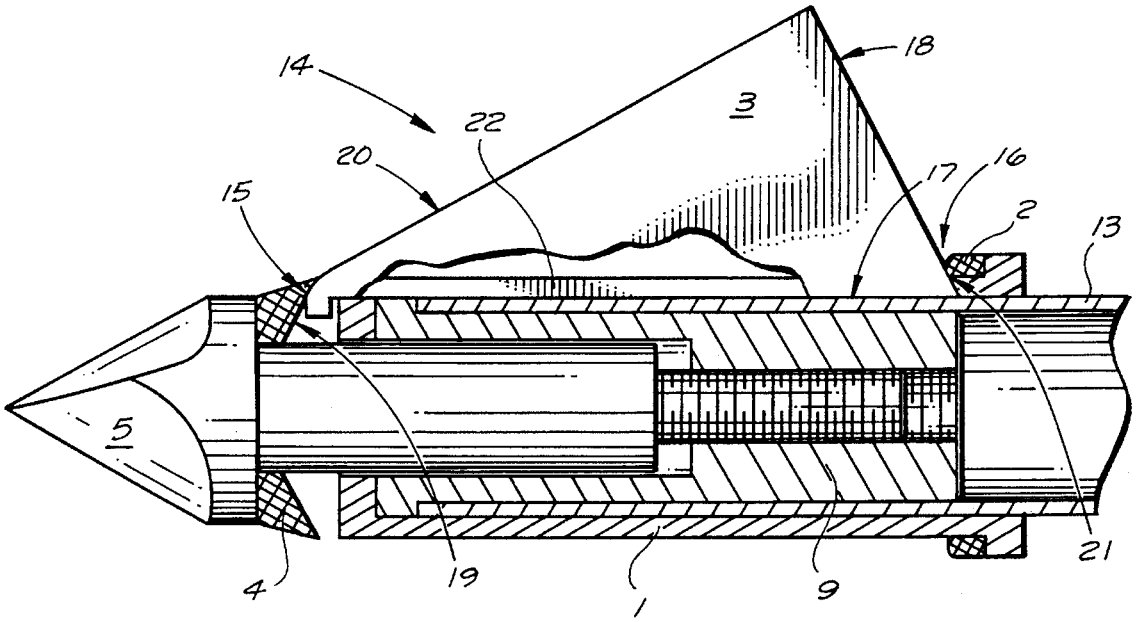
FIG. 7 is a sectional view of the overshaft broadhead when installed on a typical arrow shaft.

As seen in FIGS. 1, 6 and 7, razors 3 of the overshaft broadhead are held in position by means of slots 22 cut longitudinally through the overshaft broadhead ferrule 1 so that razors 3, when installed, will come into contact with the outside surface 17 of arrow shaft 13. The rearward edge 18 of each of razors 3 is tapered to allow a closing down, collet effect to occur as the razors 3 are axially tightened. The front, edge 20 of each of razors 3 is in contact with razor retaining washer 4, located between threaded hunting point tip 5 and broadhead ferrule 1. Razor retaining washer 4 will contact the front of the razors 3, and, when threaded hunting point tip 5 is tightened, will produce an axial load on razors 3. Razor ring 2, contained over and to the rear of broadhead ferrule 1: allows the razors 3 to slide towards the axis of arrow shaft 13 when tip 5 is tightened. Likewise, razor retaining washer 4, allows the razors 3 to slide towards the axis of arrow shaft 13 when tip 5 is tightened. Threaded arrow insert 9 located within arrow shaft 13 provides the necessary means to support and strengthen the outside diameter of arrow shaft 13 when in contact with the razors 3.

FIG. 7 is a detailed sectional view of the invention, overshaft broadhead 14, assembled and installed on raw arrow shaft 13. (For clarity, only one razor 3 is shown installed). Raw arrow shaft 13 is a thin walled tube of length L. Internally threaded arrow insert 9 slides with an interference fit into raw arrow shaft 13. Broadhead ferrule 1 slides over arrow shaft 13. Razor 3 is installed in slot 22 in ferrule 1. Razor 3 contacts the outside surface of arrow 13 along edge 17. Hunting point tip 5 is threaded, and passes through razor retaining washer 4 to screw into threaded arrow insert 9. Rotation of tip 5 (when applied to achieve final securement) creates an axial load on razor 3 at contact areas 15 and 16. A description of both contact areas follows. At contact area 15, a radius on leading edge 20 (of razor 3) is in contact with tapered edge 19 (of razor retaining washer 4). Contact area 16, edge 18 (of razor 3) is in contact with corner 21 of razor ring 2. When tip 5 is rotated to tighten, an axial force created in contact areas 15 and 16 will cause razor 3 to slide at the inclined surfaces edges 18, 19 and 20 towards the center of axis of arrow 13 and bear forcibly against edge 17 in contact with the arrows surface regardless of the radial position of ferrule 1 about arrow shaft 13. Thus, one can readily align the razors to maximize bow clearance and to achieve alignment to the arrow's flights.

In using the invention to achieve the stated objectives, the archer can exactly duplicate his arrow's finished length, weight, balance point and obtain the feature to readily align the invention to his arrow flights. This will allow the archer to achieve exact repeatable arrow flight that he has become accustomed to while using his practice arrows. The invention is so designed as to not increase the arrow's assembled length. This is accomplished by inserting the arrow shaft into the invention's ferrule body and securing it to the arrow shaft with a threaded tip. This effectively prevents a change in length to the lever arm that the tip's weight is acting upon. The weight of the invention duplicates the target point weight the archer has selected, but, is appropriately distributed to promote the same balance point as found in the practice arrow. The added feature of the invention which allows it to be readily aligned to the arrow's flights, or, to achieve adequate bow clearances, greatly simplifies the methods currently used. Assuming that the archer has been having success using an arrow point of a given weight, he will, in installing a like weight broadhead per the invention, see the same performance in arrow flight that he has become accustomed to.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such clear and concise manner that those skilled in the art may readily understand and practice the invention, That which is claimed is:

1. In an arrow having an arrow shaft with a threaded insert at a first end thereof, said insert being internal to and concentric with said shaft, and an arrow tip, having a threaded extension, thread coupled to said insert, the improvement comprising:

a broad head cutting blade;

means coupled to said shaft for coupling said broad head cutting blade to said arrow shaft at first end of said shaft and above the outer surface of said shaft;

wherein said means for coupling said broad head cutting blade to said arrow shaft further comprises means coupled to said shaft for lockingly, removably coupling said broad head cutting blade to said shaft; and wherein said means for lockingly, removeably coupling said broad head cutting blade to said shaft comprises locking means coupled to said shaft in cooperation with said arrow tip whereby the threaded rotation of said tip functions to lock and release said broad head cutting blade from its coupling with said shaft; and wherein said locking means comprises means coupling said arrow tip, said shaft, and said cutting blade for drawing said cutting blade into locked, intimate contact with said outer surface of said shaft as said tip is threadedly rotated into said threaded insert and for releasing said locked, intimate contact as said tip is threadedly rotated out of said threaded insert.

2. The improvement of claim 1 wherein said means for drawing said cutting blade into locked intimate contact with said shaft further comprises means for lockingly positioning said cutting blade at selected radial angles with respect to said shaft.

3. The improvement of claim 2 wherein said means for lockingly, removably coupling said broad head cutting blade to said shaft comprises:

a ferrule rotatingly encompassing said first end of said arrow shaft and extending a selected length away from said first end along said arrow shaft;

said broad head cutting blade removably coupled to said ferrule; and extending along said ferrule away from said first end of said arrow shaft; and means for lockingly coupling said blade and said ferrule to said shaft at a selected radial angle to said shaft.

4. In an arrow having an arrow shaft with a threaded insert at a first end thereof, said inert being internal to and concentric with said shaft, and an arrow tip, having a threaded extension, thread coupled to said insert, the improvement comprising:

a board head cutting blade;

means coupled to said shaft for coupling said broad head cutting blade to said arrow shaft at said first end of said shaft and above the outer surface of said shaft;

wherein said means for coupling said broad head cutting blade to said shaft comprises:

a ferrule rotatingly encompassing said first end of said arrow shaft and extending a selected length away from said first end along said arrow shaft;

said broad head cutting blade removably coupled to said ferrule and extending along said ferrule away from said first end of said arrow shaft; and means for lockingly coupling said blade and said ferrule to said shaft at a selected radial angle to said shaft;

wherein said means for lockingly coupling said blade and said ferrule to said shaft at a selected radial angle comprises compression means couple to said arrow tip for exerting a compressive force on said broad head cutting blade for lockingly positioning said as ferrule and said cutting blade on said arrow shaft as said arrow tip is threadedly rotated into said insert; and wherein said ferrule has an outer wall with a longitudinal slot therethrough, said broad head cutting blade coupled within said slot and thereby in contact with the surface of said arrow shaft.

* * * * *